US010392976B2

(12) United States Patent
Lin et al.

(10) Patent No.: US 10,392,976 B2
(45) Date of Patent: Aug. 27, 2019

(54) CONTINUOUSLY VARIABLE VALVE LIFT SYSTEM AND AUTOMOBILE

(71) Applicant: Guangzhou Automobile Group Co., Ltd., Guangzhou, Guangdong Province (CN)

(72) Inventors: Sicong Lin, Guangzhou (CN); Yuhuai Li, Guangzhou (CN); Jujiang Liu, Guangzhou (CN); Hainian Lian, Guangzhou (CN)

(73) Assignee: GUANGZHOU AUTOMOBILE GROUP CO., LTD., Guangzhou, Guangdong Province (CN)

( * ) Notice: Subject to any disclaimer, the term of this patent is extended or adjusted under 35 U.S.C. 154(b) by 0 days.

(21) Appl. No.: 15/752,561

(22) PCT Filed: Oct. 14, 2016

(86) PCT No.: PCT/CN2016/102103
§ 371 (c)(1),
(2) Date: Feb. 13, 2018

(87) PCT Pub. No.: WO2017/107626
PCT Pub. Date: Jun. 29, 2017

(65) Prior Publication Data

US 2018/0230863 A1 Aug. 16, 2018

(30) Foreign Application Priority Data

Dec. 24, 2015 (CN) ..... 2015 1 0996351

(51) Int. Cl.
*F01L 1/34* (2006.01)
*F01L 1/22* (2006.01)
(Continued)

(52) U.S. Cl.
CPC ..... *F01L 1/22* (2013.01); *F01L 1/047* (2013.01); *F01L 1/18* (2013.01); *F01L 1/462* (2013.01);
(Continued)

(58) Field of Classification Search
CPC ..... F01L 1/18; F01L 1/22; F01L 1/185; F01L 1/267; F01L 2013/0068
(Continued)

(56) References Cited

U.S. PATENT DOCUMENTS 7,311,070 B2 12/2007 Yamada
7,819,097 B2 * 10/2010 Shui ..... F01L 1/022 123/90.16

FOREIGN PATENT DOCUMENTS

CN 1894488 A 1/2007
CN 101182807 A 5/2008
(Continued)

*Primary Examiner* — Ching Chang
(74) *Attorney, Agent, or Firm* — Cheng-Ju Chiang

(57) ABSTRACT

A continuously variable valve lift system includes a driving swing arm, an adjusting member, an adjusting swing arm and a camshaft. The driving swing arm is provided with a first connecting part, the adjusting member is provided with a second connecting part, and the adjusting swing arm is provided with a third connecting part, wherein two sides of the second connecting part abut against the first connecting part and the third connecting part, respectively, the second connecting part abuts against the third connecting part to form a spiral surface therebetween, and the adjusting member is further capable of sliding along an axial direction of the middle shaft, and the camshaft contacts with the adjusting swing arm.

10 Claims, 7 Drawing Sheets

(51) Int. Cl.

| | |
|---|---|
| ***F01L 1/047*** | (2006.01) |
| ***F01L 1/18*** | (2006.01) |
| ***F01L 1/46*** | (2006.01) |
| ***F01L 13/00*** | (2006.01) |
| *F01L 1/053* | (2006.01) |
| *F01L 1/24* | (2006.01) |
| *F01L 1/26* | (2006.01) |

(52) U.S. Cl.
CPC ..... *F01L 13/0063* (2013.01); *F01L 1/053* (2013.01); *F01L 1/185* (2013.01); *F01L 1/2405* (2013.01); *F01L 1/267* (2013.01); *F01L 2013/0068* (2013.01)

(58) Field of Classification Search
USPC ..... 123/90.16, 90.18, 90.39, 90.44
See application file for complete search history.

(56) References Cited

FOREIGN PATENT DOCUMENTS

| | | | |
|---|---|---|---|
| CN | 101457661 | A | 6/2009 |
| CN | 103046978 | A | 4/2013 |
| CN | 103726894 | A | 4/2014 |
| CN | 103912334 | A | 7/2014 |
| CN | 105604634 | A | 5/2016 |
| DE | 19929296 | A1 | 10/2000 |
| DE | 10120451 | A1 | 10/2002 |
| DE | 10139043 | A1 | 2/2003 |
| DE | 102010060725 | A1 | 3/2012 |
| JP | 2004-183518 | A | 7/2004 |
| JP | 4063622 | B2 | 3/2008 |
| JP | 4108295 | B2 | 6/2008 |
| JP | 4185869 | B2 | 11/2008 |
| KR | 10-1511958 | B1 | 4/2015 |

* cited by examiner

CONTINUOUSLY VARIABLE VALVE LIFT SYSTEM AND AUTOMOBILE

CROSS REFERENCE TO RELATED APPLICATIONS

This application is a 35 U.S.C. § 371 National Phase conversion of International (PCT) Patent Application No. PCT/CN2016/102103, filed on Oct. 14, 2016, which claims the priority of Chinese Patent Application No. 201510996351.7, filed on Dec. 24, 2015. The contents of the above-identified applications are incorporated herein reference. The PCT International Patent Application was filed and published in Chinese.

TECHNICAL FIELD

The present application relates to an engine of an automobile, and particularly to a continuously variable valve lift system and an automobile having the same.

BACKGROUND

During operation of reciprocating internal combustion engine, the valve can be opened and closed regularly through the valve driving mechanism, such that the engine can effectively absorb fresh air or combustible mixture, and can discharge the exhaust gas from the cylinder. After a valve driving mechanism is designed, movement of the valve is fixed. Valve lift and duration of valve opening cannot be adjusted according to actual operations of the engine.

The engine of automobile is running in all conditions. In design, it is necessary to take into account both power in high load and economy in low load. However, the fixed movement of the valve endows the engine a best state only in a particular working condition. It is unable to reconcile the demands of power and economy in most cases for the engine.

In order to overcome such defect of the engine, variable valve lift systems are increasingly used in engines. However, existing variable valve lift systems are complex in structure and difficult to manufacture, and the duration of valve opening cannot be adjusted.

SUMMARY

In view of the above, the present application provides a continuously variable valve lift system and an automobile having the same, which has a simple structure, and the valve lift and the duration of valve opening can be adjusted.

The present application provides a continuously variable valve lift system. The continuously variable valve lift system includes a driving swing arm, a camshaft and a valve structure. The valve structure includes a roller rocker arm and a valve connected to the roller rocker arm. The driving swing arm has a driving surface. The driving surface contacts with the roller rocker arm to drive the valve to perform a reciprocating movement. The continuously variable valve lift system further includes a middle shaft, an adjusting member and an adjusting swing arm. The driving swing arm, the adjusting member and the adjusting swing arm are sleeved on the middle shaft and are respectively capable of swinging around the middle shaft. The driving swing arm is provided with a first connecting part. The adjusting member is provided with a second connecting part. The adjusting swing arm is provided with a third connecting part. The first connecting part, the second connecting part and the third connecting part are arranged sequentially along a circumferential direction of the middle shaft. The second connecting part is located between the first connecting part and the third connecting part, and two sides of the second connecting part abut against the first connecting part and the third connecting part, respectively. The second connecting part abuts against the third connecting part to form a spiral surface therebetween. The adjusting member is further capable of sliding along an axial direction of the middle shaft. The camshaft contacts with the adjusting swing arm.

Further, a first end of the second connecting part has a width smaller than a second end of the second connecting part. A first end of the third connecting part has a width greater than a second end of the third connecting part. Side edges of the second connecting part and the third connecting part that abut against each other are spiral oblique lines.

Further, the second connecting part abuts against the third connecting part to form a first contact surface therebetween. The first contact surface is a spiral surface. The second connecting part abuts against the first connecting part to form a second contact surface therebetween. The second contact surface is a flat surface being parallel to the axis of the middle shaft.

Further, the adjusting swing arm is provided with a roller. The camshaft is provided with a cam. The cam forms a rolling friction contact with the roller.

Further, the driving swing arm is provided with two first circular rings. The adjusting member is provided with two second circular rings. The adjusting swing arm is provided with two third circular rings. The first connecting part is connected between the two first circular rings. The second connecting part is connected between the two second circular rings. The third connecting part is connected between the two third circular rings. The driving swing arm is sleeved on the middle shaft by the two first circular rings. The adjusting member is sleeved on the middle shaft by the two second circular rings. The adjusting swing arm is sleeved on the middle shaft by the two third circular rings.

Further, each first circular ring is connected with a driving surface. The valve structure has two in quantity. Each driving surface and each valve structure are disposed correspondingly to constitute a valve adjusting system.

Further, on the middle shaft, the two first circular rings are disposed between the two second circular rings, and the two third circular rings are disposed between the two first circular rings.

Further, the middle shaft includes a middle section and two sliding sections connected respectively at two ends of the middle section. The middle section has a diameter smaller than the sliding sections. The two second circular rings are respectively sleeved on the two sliding sections and are capable of sliding along the two sliding sections. The two first circular rings and the two third circular rings are sleeved on the middle section.

Further, the continuously variable valve lift system further comprises a return spring, one end of the return spring is fixed to a casing of the engine, and the other end of the return spring is fixed to the driving swing arm.

The present application further provides an automobile, and the automobile has the above-mentioned continuously variable valve lift system.

In conclusion, the adjusting member, the adjusting swing arm and the driving swing arm are provided in the present application, and the contact surface between the adjusting member and the adjusting swing arm is a spiral surface. An axial linear movement of the adjusting member can be transformed to a rotation of the adjusting swing arm to change the relative angle between the adjusting swing arm and the driving swing arm, such that the swing angle of the driving swing arm is changed, to thereby achieve the purpose of adjusting the valve lift and the duration of valve opening. Thus, the continuously variable valve lift system provided by the present application has a simple structure. The valve lift and the duration of valve opening can be adjusted simultaneously.

The above contents are only a summary of the technical solution of the present application. In order to make the technical solution of the present application more clearly such that it can be carried out according to the description of the specification, and to make the purposes, characteristics and advantages of the present application more apparently, the present application will now be described specifically with reference to the following preferred embodiments when taken in conjunction with the accompanying drawings.

DETAILED DESCRIPTION OF PREFERRED EMBODIMENTS

In order to further describe the technical solutions and effects of the present application for achieving the intended purposes, the present application will now be described specifically with reference to the following preferred embodiments when taken in conjunction with the accompanying drawings.

Figure 1:
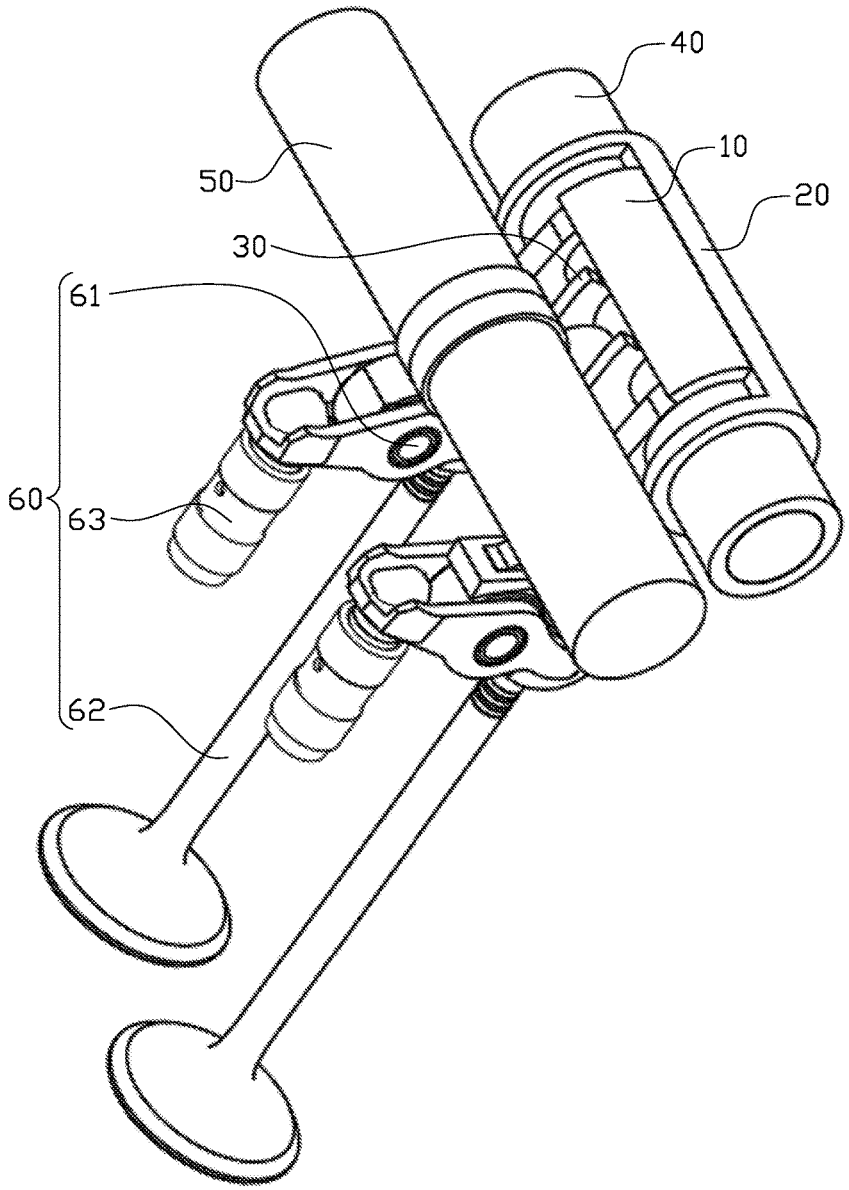
FIG. 1 is an isometric view of a continuously variable valve lift system provided according to an embodiment of the present application.
Figure 2:
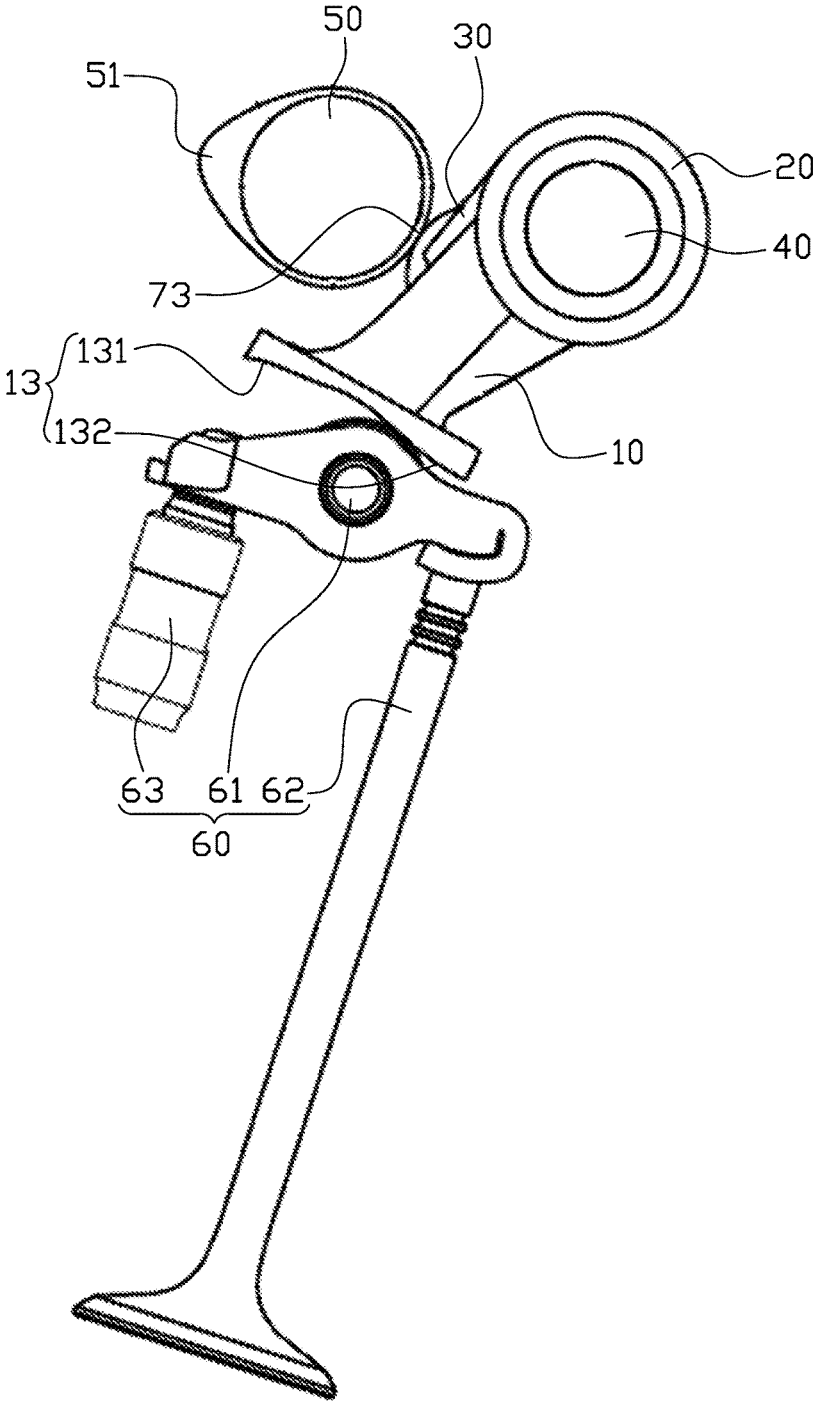
FIG. 2 is a side view of the continuously variable valve lift system of FIG. 1.
Figure 3:
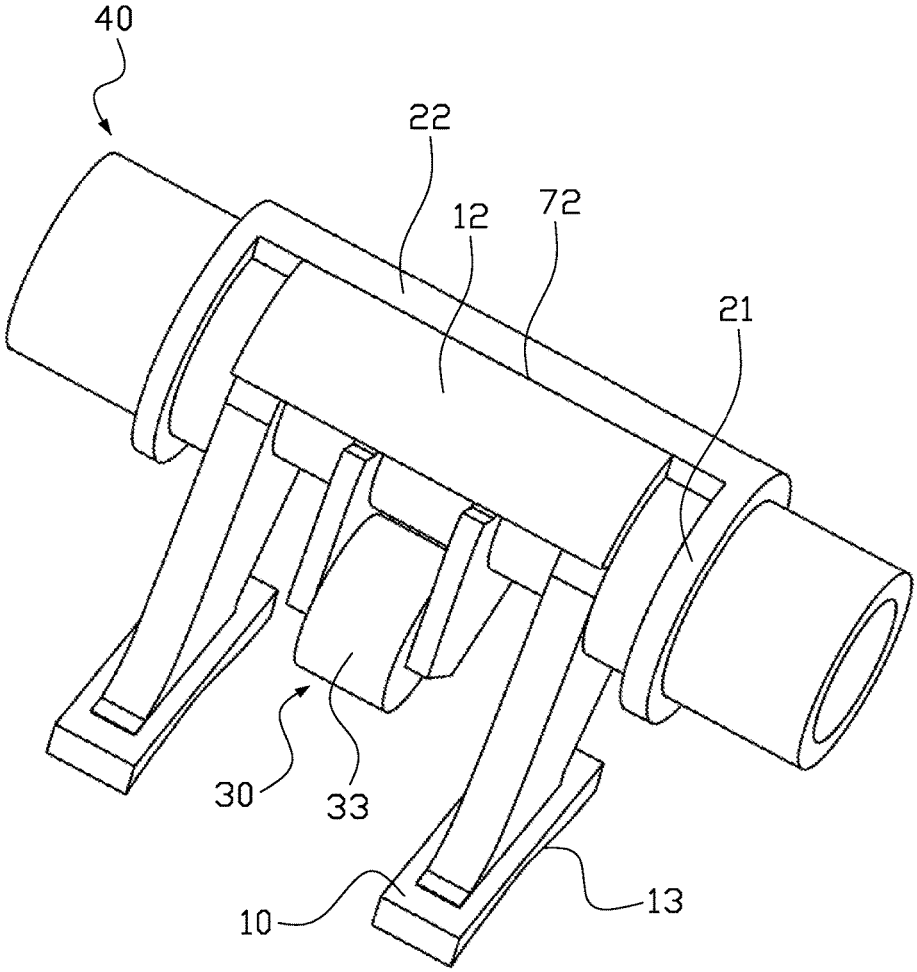
FIG. 3 is an isometric view of the middle shaft, the adjusting swing arm, the driving swing arm and the adjusting member of FIG. 1 when connected together.
Figure 4:
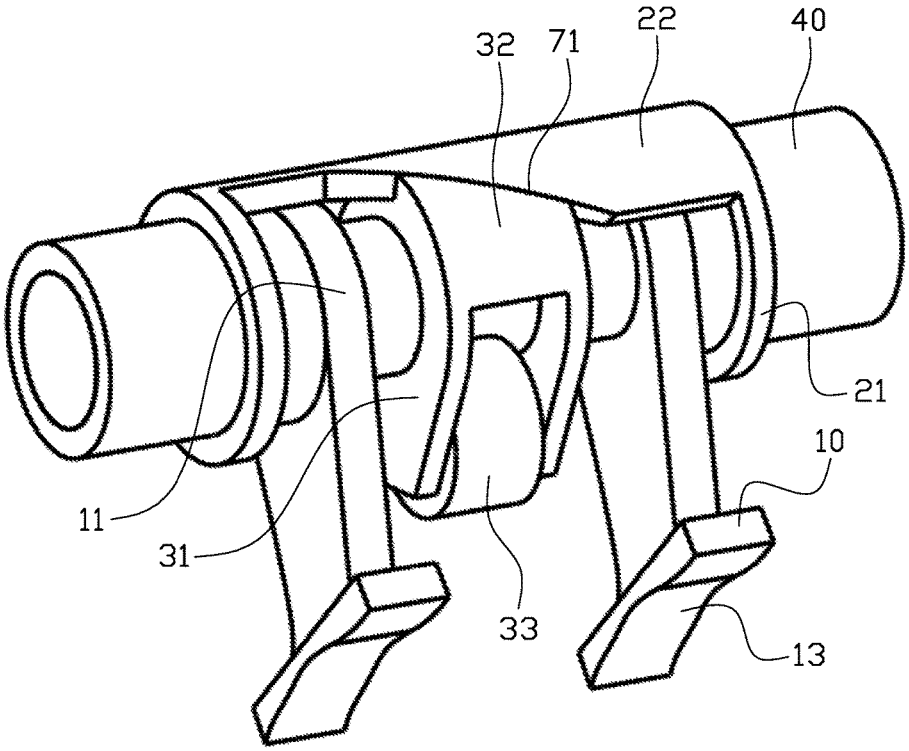
FIG. 4 is another point of view of FIG. 3.
Figure 5:
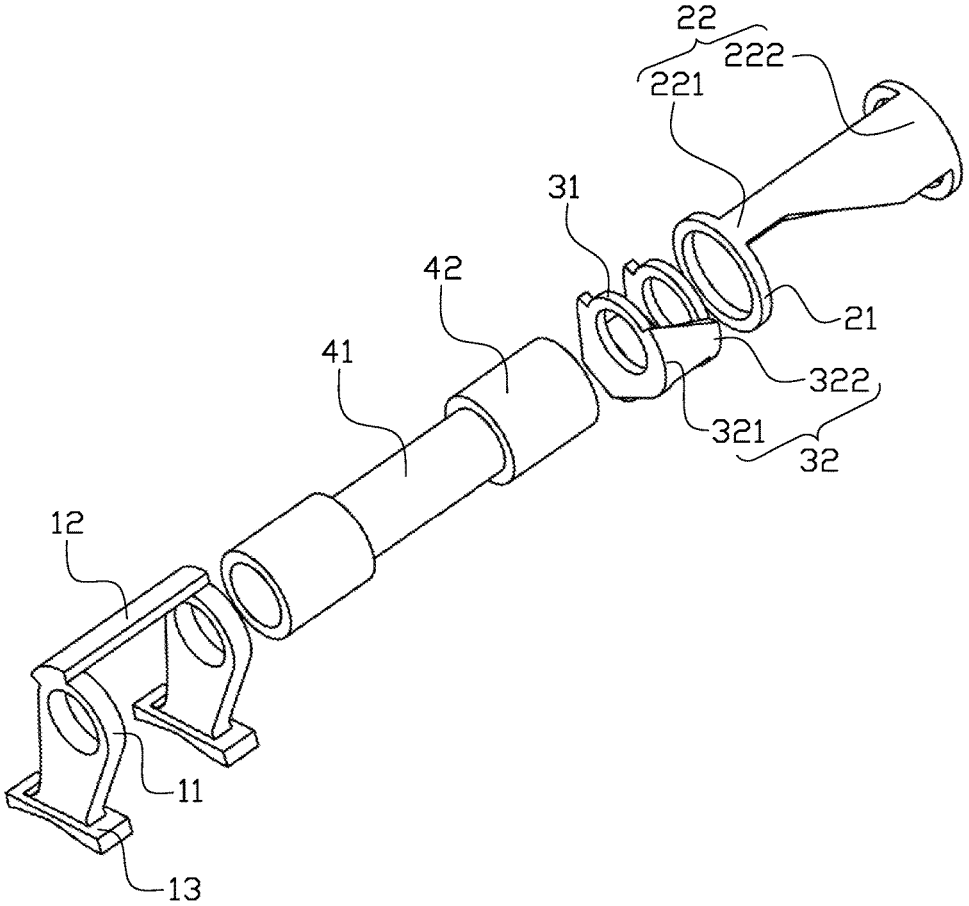
FIG. 5 is an exploded view of FIG. 3.
Figure 6:
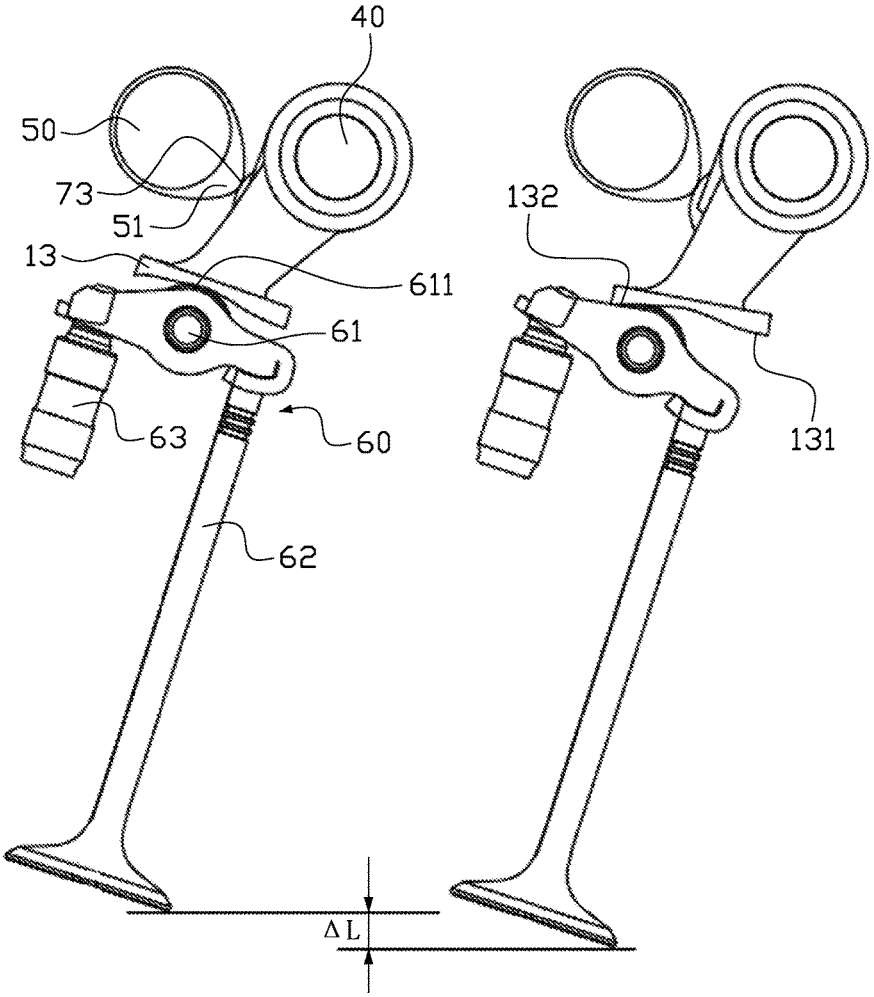
FIG. 6 is a contrasting view showing that the valve lift of the continuously variable valve lift system of FIG. 1 is adjusted.

The present application provides a continuously variable valve lift system. FIG. 1 is an isometric view of a continuously variable valve lift system provided according to an embodiment of the present application. FIG. 2 is a side view of the continuously variable valve lift system of FIG. 1. FIG. 3 is an isometric view of the middle shaft, the adjusting swing arm, the driving swing arm and the adjusting member of FIG. 1 when connected together. FIG. 4 is another point of view of FIG. 3. FIG. 5 is an exploded view of FIG. 3. FIG. 6 is a contrasting view showing that the valve lift of the continuously variable valve lift system of FIG. 1 is adjusted. As shown in FIGS. 1-6, the continuously variable valve lift system provided by the present application includes a driving swing arm 10, an adjusting member 20, an adjusting swing arm 30, a middle shaft 40, a camshaft 50, and a valve structure 60. The valve structure 60 includes a roller rocker arm 61 and a valve 62 connected to the roller rocker arm 61.

The driving swing arm 10 is sleeved on the middle shaft 40 and is capable of swinging around the middle shaft 40. In the embodiment, the driving swing arm 10 includes a first circular ring 11, a first connecting part 12 and a driving surface 13. The first circular ring 11 is located on the top of the driving swing arm 10 and sleeved on the middle shaft 40, to cause the driving swing arm 10 to be capable of swinging around the middle shaft 40. The first circular ring 11 may have two in quantity, the two first circular rings 11 are spaced from each other, and the first connecting part 12 is disposed between the two first circular rings 11 and connected with the two first circular rings 11. A side edge of the first connecting part 12 that is located adjacent to the adjusting member 20 is a straight line being parallel to the axis of the middle shaft 40. Driving surfaces 13 are provided at the bottom of the driving swing arm 10 for driving the valve structure 60. Each first circular ring 11 is connected with a driving surface 13. There is an arc segment formed at the left side of the driving surface 13, and the left-side arc segment takes the middle shaft 40 as its center to form as a blanking segment 131. A driving segment 132 is formed at the right side of the driving surface 13 for driving the roller rocker arm 61. Each driving surface 13 contacts with a roller 611 of a roller rocker arm 61 to drive the valve 62 to perform a reciprocating movement. The valve structure 60 may have two in quantity, each driving surface 13 and each valve structure 60 are disposed correspondingly to constitute a valve adjusting system.

The adjusting member 20 is sleeved on the middle shaft 40, and is capable of swinging around the middle shaft 40 and sliding along the axial direction of the middle shaft 40. In the embodiment, the adjusting member 20 includes a second circular ring 21 and a second connecting part 22. The second circular ring 21 is sleeved on the middle shaft 40, to cause the adjusting member 20 to be capable of swinging around the middle shaft 40 and sliding along the axial direction of the middle shaft 40. The second circular ring 21 may have two in quantity, the two second circular rings 21 are spaced from each other, and the second connecting part 22 is disposed between the two second circular rings 21 and connected with the two second circular rings 21. The first end 221 of the second connecting part 22 has a width smaller than the second end 222 of the second connecting part 22. A side edge of the second connecting part 22 that is located adjacent to the first connecting part 12 is a straight line being parallel to the axis of the middle shaft 40, and the other opposite side edge of the second connecting part 22 is a spiral oblique line.

The adjusting swing arm 30 is sleeved on the middle shaft 40 and is capable of swinging around the middle shaft 40. In the embodiment, the adjusting swing arm 30 includes a third circular ring 31, a third connecting part 32 and a roller 33. The third circular ring 31 is located on the top of the adjusting swing arm 30 and sleeved on the middle shaft 40, to cause the adjusting swing arm 30 to be capable of swinging around the middle shaft 40. The third circular ring 31 may have two in quantity, the two third circular rings 31 are spaced from each other, and the third connecting part 32 is disposed between the two third circular rings 31 and connected with the two third circular rings 31. Opposite to the second connecting part 22, the first end 321 of the third connecting part 32 has a width greater than the second end 322 of the third connecting part 32. A side edge of the third connecting part 32 that abuts against the second connecting part 22 of the adjusting member 20 is a spiral oblique line, the same as the second connecting part 22. The roller 33 of the adjusting swing arm 30 is located far away from the middle shaft 40 and disposed between the two third circular rings 31. The roller 33 is configured to contact with the camshaft 50.

That is, in the above-mentioned continuously variable valve lift system, the adjusting member 20, the driving swing arm 10 and the adjusting swing arm 30 are sleeved on the middle shaft 40 and are respectively capable of rotating around the axis of the middle shaft 40. Further, the adjusting member 20 is capable of sliding along the axial direction of the middle shaft 40. When the driving swing arm 10, the adjusting member 20 and the adjusting swing arm 30 are mounted on the middle shaft 40, the first connecting part 12, the second connecting part 22 and the third connecting part 32 are arranged sequentially along a circumferential direction of the middle shaft 40. The second connecting part 22 is located between the first connecting part 12 and the third connecting part 32, two sides of the second connecting part 22 abut against the first connecting part 12 and the third connecting part 32, respectively. One side edge of the second connecting part 22 abuts against the side edge of the third connecting part 32 to form a first contact surface 71, and the first contact surface 71 is a spiral surface. The rotation axis of the adjusting swing arm 30 is the axis of the middle shaft 40. In the embodiment, the other side edge of the second connecting part 22 abuts against the side edge of the first connecting part 12 to form a second contact surface 72, and the second contact surface 72 is a flat surface being parallel to the axis of the middle shaft 40.

More specifically, referring to FIG. 5 and FIG. 6, on the middle shaft 40, the two first circular rings 11 are disposed between the two second circular rings 21, and the two third circular rings 31 are disposed between the two first circular rings 11. The middle shaft 40 includes a middle section 41 and two sliding sections 42 connected respectively at two ends of the middle section 41. The middle section 41 has a diameter smaller than the sliding sections 42. The two second circular rings 21 are respectively sleeved on the two sliding sections 42 and are capable of sliding along the two sliding sections 42. The two first circular rings 11 and the two third circular rings 31 are sleeved on the middle section 41.

The camshaft 50 and the middle shaft 40 are arranged in parallel. A cam 51 is provided on the camshaft 50. The cam 51 forms a rolling friction contact with the roller 33 of the adjusting swing arm 30 at a third contact surface 73.

When the continuously variable valve lift system provided by the embodiment of the present application controls the opening and closing of the valve 62, the cam 51 of the camshaft 50 drives the adjusting swing arm 30 to swing around the middle shaft 40 by the third contact surface 73. The adjusting swing arm 30 drives the adjusting member 20 to swing around the middle shaft 40 by the first contact surface 71. The adjusting member 20 drives the driving swing arm 10 to swing around the middle shaft 40 by the second contact surface 72. The driving swing arm 10 drives the valve 62 to move upward and downward in a reciprocating manner by the contact between the driving surface 13 and the roller 611 of the roller rocker arm 61. When the roller rocker arm 61 slides along the driving segment 132 of the driving surface 13, the valve 62 is opened; when the roller rocker arm 61 slides along the blanking segment 131 of the driving surface 13, the valve 62 is closed.

When the valve lift and the duration of valve opening of the continuously variable valve lift system provided by the embodiment of the present application are adjusted, the adjusting member 20 is driven to slide along the axial direction of the middle shaft 40 by an electric motor (not shown). Because the first contact surface 71 between the second connecting part 22 of the adjusting member 20 and the third connecting part 32 of the adjusting swing arm 30 is a spiral surface, an axial linear movement of the adjusting member 20 along the middle shaft 40 will be transformed to a rotation of the adjusting swing arm 30 around the middle shaft 40 due to the spiral surface of the first contact surface 71. That is, the adjusting member 20 drives the adjusting swing arm 30 to swing around the middle shaft 40 under the action of the spiral surface of the first contact surface 71, thereby adjusting the relative angle between the adjusting swing arm 30 and the driving swing arm 10. As the relative angle between the adjusting swing arm 30 and the driving swing arm 10 changes, the swing angle of the driving swing arm 10 will be changed in the period when the camshaft 50 rotates a circle, to thereby realize the adjustment of the valve lift and the duration of valve opening. In the present application, when the adjusting member 20 moves towards a first end of the second connecting part 22 (i.e., the narrower end of the second connecting part 22), the relative angle between the adjusting swing arm 30 and the driving swing arm 10 is increased, and the swing angle of the driving swing arm 10 is increased, such that the valve lift is increased and the duration of valve opening is increased; when the adjusting member 20 moves towards a second end of the second connecting part 22 (i.e., the wider end of the second connecting part 22), the relative angle between the adjusting swing arm 30 and the driving swing arm 10 is decreased, such that the valve lift is decreased and the duration of valve opening is decreased.

Figure 7:
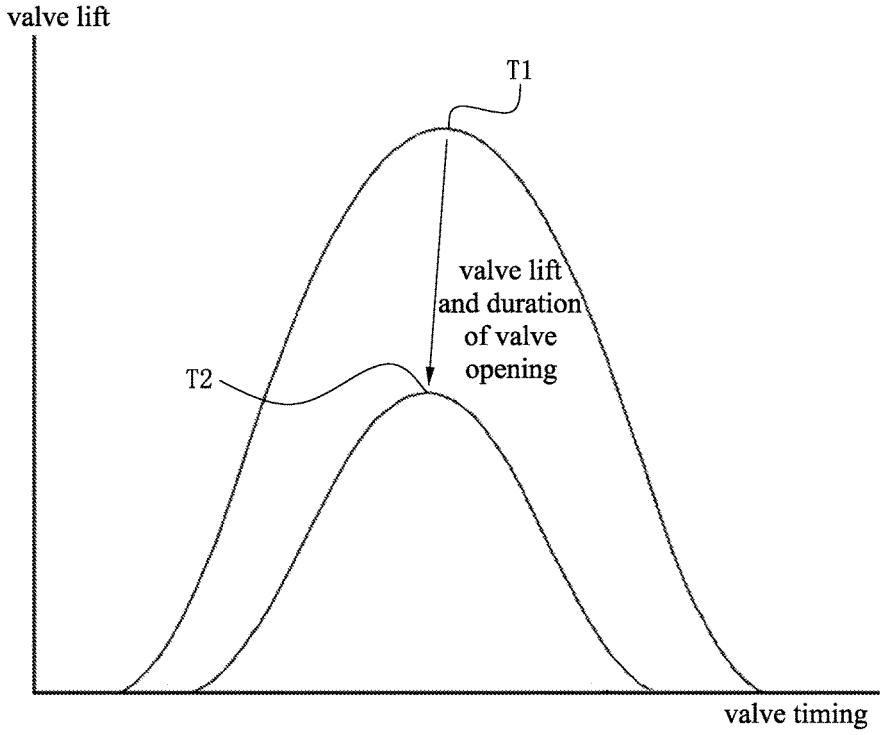
FIG. 7 is a schematic diagram showing relationship between the valve lift and the valve timing of the continuously variable valve lift system of FIG. 1.

FIG. 7 is a schematic diagram showing relationship between the valve lift and the valve timing of the continuously variable valve lift system of FIG. 1. As shown in FIG. 7, the abscissa axis denotes the valve timing, and the ordinate axis denotes the valve lift. When the ordinate value is zero, the difference of the two abscissa values represented by the valve timing is the duration of valve opening. In the present application, when the valve lift is changed, the valve timing corresponding to the highest valve lift will not be changed (i.e., T1 and T2 represent the same). From FIG. 7, it can be seen that, as the valve lift is adjusted to be increased, the duration of valve opening is increased; as the valve lift is adjusted to be decreased, the duration of valve opening is decreased.

Accordingly, in the continuously variable valve lift system provided by the embodiment of the present application, the valve lift, the duration of valve opening and the phase corresponding to the maximal valve lift can be continuously adjusted as the position of the adjusting swing arm 30 is adjusted by the adjusting member 20. The demands of power and economy for the engine are reconciled. The maximal torque and the maximal power of the engine can be increased by using a large valve lift in high load areas, and a small valve lift can be used to control the air entering the combustion chamber in low load areas, to increase the tumble in the cylinder, optimize the combustion, reduce the loss of pumped gas and improve the fuel economy.

In addition, in order to ensure the driving swing arm 10, the adjusting member 20 and the adjusting swing arm 30 are always in contact with each other, the continuously variable valve lift system provided by the embodiment of the present application further includes a return spring (not shown). One end of the return spring is fixed to a casing of the engine, and the other end of the return spring is fixed to the driving swing arm 10.

In addition, the valve structure 60 further includes a hydraulic lifter 63. The valve 62 and the hydraulic lifter 63 are disposed respectively at two sides of the roller rocker arm 61. The hydraulic lifter 63 is configured to automatically adjust the valve interval of the valve 62.

The present application further provides an automobile, and the automobile has the above-mentioned continuously variable valve lift system. Other structures relating to the automobile can refer to existing technology and are herein omitted for clarity.

Accordingly, the continuously variable valve lift system provided by the present application has a simple structure. The adjusting member and the adjusting swing arm are provided, and the contact surface between the adjusting member and the adjusting swing arm is a spiral surface. An axial linear movement of the adjusting member can change the relative angle between the adjusting swing arm and the driving swing arm, such that the swing angle of the driving swing arm is changed, to thereby adjust the valve lift and the duration of valve opening. Thus, the engine can adopt different valve lifts in high load areas and in low load areas, to reconcile the demands of power and economy.

The above are embodiments of the present application only, and should not be deemed as limitations to the present application. Although the present application has been described with preferred embodiments, it should be noted that variations and improvements will become apparent to those skilled in the art to which the present application pertains. Therefore, the scope of the present application is defined by the appended claims.

INDUSTRIAL APPLICABILITY

The continuously variable valve lift system provided by the present application has a simple structure. The adjusting member and the adjusting swing arm are provided, and the contact surface between the adjusting member and the adjusting swing arm is a spiral surface. An axial linear movement of the adjusting member can change the relative angle between the adjusting swing arm and the driving swing arm, such that the swing angle of the driving swing arm is changed, to thereby adjust the valve lift and the duration of valve opening. Thus, the engine can adopt different valve lifts in high load areas and in low load areas, to reconcile the demands of power and economy.

What is claimed is:

1. A continuously variable valve lift system, comprising a driving swing arm, a camshaft and a valve structure, the valve structure comprising a roller rocker arm and a valve connected to the roller rocker arm, the driving swing arm having a driving surface, the driving surface contacting with the roller rocker arm to drive the valve to perform a reciprocating movement, wherein the continuously variable valve lift system further comprises a middle shaft, an adjusting member and an adjusting swing arm, the driving swing arm, the adjusting member and the adjusting swing arm are sleeved on the middle shaft and are respectively capable of swinging around the middle shaft, the driving swing arm is provided with a first connecting part, the adjusting member is provided with a second connecting part, the adjusting swing arm is provided with a third connecting part, the first connecting part, the second connecting part and the third connecting part are arranged sequentially along a circumferential direction of the middle shaft, the second connecting part is located between the first connecting part and the third connecting part, two sides of the second connecting part abut against the first connecting part and the third connecting part, respectively, the second connecting part abuts against the third connecting part to form a spiral surface therebetween, the adjusting member is further capable of sliding along an axial direction of the middle shaft, the camshaft contacts with the adjusting swing arm.

2. The continuously variable valve lift system of claim 1, wherein a first end of the second connecting part has a width smaller than a second end of the second connecting part, a first end of the third connecting part has a width greater than a second end of the third connecting part, side edges of the second connecting part and the third connecting part that abut against each other are spiral oblique lines.

3. The continuously variable valve lift system of claim 1, wherein the second connecting part abuts against the third connecting part to form a first contact surface therebetween, the first contact surface is a spiral surface, the second connecting part abuts against the first connecting part to form a second contact surface therebetween, the second contact surface is a flat surface being parallel to the axis of the middle shaft.

4. The continuously variable valve lift system of claim 1, wherein the adjusting swing arm is provided with a roller, the camshaft is provided with a cam, the cam forms a rolling friction contact with the roller.

5. The continuously variable valve lift system of claim 1, wherein the driving swing arm is provided with two first circular rings, the adjusting member is provided with two second circular rings, the adjusting swing arm is provided with two third circular rings, the first connecting part is connected between the two first circular rings, the second connecting part is connected between the two second circular rings, the third connecting part is connected between the two third circular rings, the driving swing arm is sleeved on the middle shaft by the two first circular rings, the adjusting member is sleeved on the middle shaft by the two second circular rings, the adjusting swing arm is sleeved on the middle shaft by the two third circular rings.

6. The continuously variable valve lift system of claim 5, wherein each first circular ring is connected with a driving surface, the valve structure has two in quantity, each driving surface and each valve structure are disposed correspondingly to constitute a valve adjusting system.

7. The continuously variable valve lift system of claim 5, wherein on the middle shaft, the two first circular rings are disposed between the two second circular rings, the two third circular rings are disposed between the two first circular rings.

8. The continuously variable valve lift system of claim 7, wherein the middle shaft includes a middle section and two sliding sections connected respectively at two ends of the middle section, the middle section has a diameter smaller than the sliding sections, the two second circular rings are respectively sleeved on the two sliding sections and are capable of sliding along the two sliding sections, the two first circular rings and the two third circular rings are sleeved on the middle section.

9. The continuously variable valve lift system of claim 1, wherein the continuously variable valve lift system further comprises a return spring, one end of the return spring is fixed to a casing of the engine, and the other end of the return spring is fixed to the driving swing arm.

10. An automobile comprising the continuously variable valve lift system of claim 1.

* * * * *